US008757980B2

(12) United States Patent
Belmonte et al.

(10) Patent No.: US 8,757,980 B2
(45) Date of Patent: Jun. 24, 2014

(54) ROTOR FOR A GAS TURBINE ENGINE COMPRISING A ROTOR SPOOL AND A ROTOR RING

(75) Inventors: Olivier Belmonte, Perthes en Gatinais (FR); Lionel Rene Henri Weller, Champcueil (FR)

(73) Assignee: SNECMA, Paris (FR)

( * ) Notice: Subject to any disclaimer, the term of this patent is extended or adjusted under 35 U.S.C. 154(b) by 610 days.

(21) Appl. No.: 13/077,033

(22) Filed: Mar. 31, 2011

(65) Prior Publication Data

US 2011/0239661 A1 Oct. 6, 2011

(30) Foreign Application Priority Data

Apr. 1, 2010 (FR) ..... 10 52495

(51) Int. Cl.
*F01D 5/30* (2006.01)

(52) U.S. Cl.
USPC ..... 416/198 A; 416/219 R

(58) Field of Classification Search
USPC ..... 416/198 A, 198 R, 200 R, 201 R, 219 R, 416/204 R, 220 R, 204 A
See application file for complete search history.

(56) References Cited

U.S. PATENT DOCUMENTS

| | | | | |
|---|---|---|---|---|
| 2,928,649 | A | 3/1960 | Lombard et al. | |
| 3,393,533 | A | 7/1968 | Wilkinson | |
| 3,894,324 | A | 7/1975 | Holzapfel et al. | |
| 4,730,983 | A * | 3/1988 | Naudet et al. | 416/220 R |
| 6,416,276 | B1 | 7/2002 | Marmilic et al. | |
| 2005/0254950 | A1 | 11/2005 | Mons | |
| 2009/0304495 | A1 * | 12/2009 | Bart et al. | 415/116 |
| 2010/0046868 | A1 | 2/2010 | Belmonte et al. | |

FOREIGN PATENT DOCUMENTS

| | | |
|---|---|---|
| DE | 199 14 227 A 1 | 10/2000 |
| EP | 1 406 019 A1 | 4/2004 |
| FR | 2.150.094 | 3/1973 |
| FR | 2 932 221 | 12/2009 |
| GB | 755841 | 8/1956 |

OTHER PUBLICATIONS

French Preliminary Search Report issued Nov. 11, 2010, in French 1052495, filed Apr. 1. 2010 (with English Translation of Category of Cited Documents).

* cited by examiner

*Primary Examiner* — Nathaniel Wiehe
*Assistant Examiner* — Aaron Jagoda
(74) *Attorney, Agent, or Firm* — Oblon, Spivak, McClelland, Maier & Neustadt, L.L.P.

(57) ABSTRACT

A one-piece rotor spool for a gas turbine engine extending along the axis of the engine is disclosed. The spool includes an upstream portion and a downstream portion that are radially offset relative to one another. The radially outer downstream portion includes a plurality of housings for rotor blades formed in the outer surface of the radially outer downstream portion. The radially inner upstream portion includes an attachment mechanism designed to interact with a rotor ring in order to prevent a tangential movement of the rotor ring relative to the radially inner upstream portion.

7 Claims, 2 Drawing Sheets

ROTOR FOR A GAS TURBINE ENGINE COMPRISING A ROTOR SPOOL AND A ROTOR RING

BACKGROUND OF THE INVENTION

1. Field of the Invention

The present invention relates to the field of gas turbine engines and is intended more particularly to make it easier to manufacture and mount a low-pressure turbine in a gas turbine engine.

2. Description of the Related Art

A front-fan and bypass turbojet, for example, conventionally comprises, from upstream to downstream, a fan, a low-pressure compressor stage, a high-pressure compressor stage, a combustion chamber, a high-pressure turbine stage and a low-pressure turbine stage.

By convention, in the present application, the terms "upstream" and "downstream" are defined relative to the direction of travel of the air in the turbojet. Similarly, by convention in the present application, the terms "inner" and "outer" are defined radially relative to the axis of the engine. Therefore, a cylinder extending along the axis of the engine comprises an inner face turned toward the axis of the engine and an outer face opposite to its inner face.

A low-pressure turbine comprises successive rotor disks each comprising axial or oblique grooves in which blade roots are engaged, the blades extending radially outward relative to the axis of the engine. The blade roots are held radially in the grooves of the rotor disk by their bulbous section, called dovetailed and, axially, by an upstream annular retaining ring in axial abutment on an upstream portion of the blade roots. The grooves of the rotor disk are conventionally made by a method known to those skilled in the art as "broaching" which consists in drilling longitudinally, with the aid of a substantially conically shaped bit, the radially outer portion of a plain that is to say an ungrooved, rotor disk. When the grooves are formed, the bit passes right through the rotor disk.

One of the challenges that the aviation industry has to overcome consists in reducing the weight of the engines. To achieve this objective, it has been proposed to combine the consecutive rotor disks into a single part, called a "spool". A rotor spool takes the form of an axial cylinder in which one or more series of blades are mounted. Accordingly, when the rotor spool comprises two series of blades, which is the equivalent of two rotor disks, it is conventionally called "Spool 1-2". A rotor spool, in comparison with a plurality of rotor disks, makes it possible to dispense with inter-disk connecting means and thus to lighten the engine. Such a spool is shown in patent application FR 0958567, not published, by SNECMA.

With reference to FIG. 1, a rotor spool 10 according to the prior art comprises an upstream portion 10A in which are arranged upstream grooves 14A in order to retain a plurality of upstream blades 4A and a downstream portion 10B in which are arranged downstream grooves 14B in order to retain a plurality of downstream blades 4B. The downstream portion 10B is connected to its upstream portion 10A by a frustoconical portion 11 that is flared from upstream to downstream. In other words, the downstream portion 10B is offset radially outward relative to the upstream portion 10A of the spool 10.

For such a spool 10, the broaching of the grooves 14B of the downstream portion 10B of the spool 10 can be applied in a conventional manner, the bit passing right through the downstream portion 10B of the spool 10 in order to form the downstream grooves 14B of the downstream blades 4B. The bit moves from downstream to upstream in the downstream portion 10B of the spool 10.

On the other hand, the broaching of the upstream grooves 14A of the upstream portion 10A of the spool 10 cannot be carried out. Specifically, the bit cannot move from downstream to upstream in the upstream portion 10A of the spool 10 because of the downstream portion 10B of the spool 10 which prevents it being positioned downstream. Moreover, the bit cannot move from upstream to downstream in the upstream portion 10A of the spool 10 because the bit would complete its travel in the frustoconical portion 11 of the spool 10 which would damage it. In other words, the bit cannot pass right through the upstream portion 10A of the spool 10 which is a drawback.

An immediate solution would then be to have a rotor drum in two portions (an upstream portion and a downstream portion) that could then be broached independently of one another. It is then sufficient to weld the two portions together. However, this means that the rotor spool must be heat treated after welding. Such a treatment is likely to deform the spool, which is undesirable.

Another immediate solution, with reference to FIG. 1, consists in connecting the upstream and downstream portions by friction welding. However, such a welding induces inaccuracies of axial positioning of the upstream portion of the spool with its downstream portion, which is a drawback.

In addition to this drawback, a rotor spool, as shown in FIG. 1, is difficult to install in the engine. For an installation from the rear of the engine, the elements of the engine are inserted from downstream to upstream. For a one-piece spool, if the spool 10 is installed with its upstream blades 4A and its downstream blades 4B, it is difficult to place the stator blades 5 situated between the two series of blades because the downstream portion 10B of the rotor spool 10 prevents access to the location of installation.

BRIEF SUMMARY OF THE INVENTION

In order to solve at least some of these drawbacks, the invention relates to a one-piece rotor spool for a gas turbine engine extending along the axis of the engine, the spool comprising an upstream portion and a downstream portion that are radially offset relative to one another, the radially outer portion comprising a plurality of housings for rotor blades formed in the outer surface of the radially outer portion, the spool being characterized by the fact that the radially inner portion comprises attachment means designed to interact with a rotor ring in order to prevent a tangential movement of the rotor ring relative to the radially inner portion.

Such a one-piece rotor spool can be easily broached because its radially inner portion can receive a broached ring independently. Moreover, because of the modular structure of the spool and of the ring, the mounting of the stator blades between the rotor blades is easy. Moreover, the attachment means make it possible to transmit the torque received by the rotor ring without increasing the complexity of the rotor spool.

Still preferably, the attachment means are arranged in order to allow an axial movement of the rotor ring relative to the radially inner portion in order to allow a simple installation through the rear of the engine. Advantageously, the attachment means take the form of attachment teeth extending radially outward. Therefore, the spool receives the driving torque and not the centrifugal forces.

According to one aspect of the invention, the radially outer portion corresponds to the downstream portion and the radially inner portion corresponds to the upstream portion.

The invention also relates to a rotor ring for a rotor spool as explained above, the ring comprising a plurality of housings for rotor blades formed in the outer surface of the ring, attachment means, formed in the inner surface of the ring, designed to interact with the outer surface of said rotor spool in order to prevent a tangential movement of the ring relative to said rotor spool.

The rotor ring can be broached independently without prejudice to the performance of the rotor.

Preferably, the attachment means take the form of attachment recesses extending radially inward.

Therefore, any centrifugal force applied to the rotor ring is not transmitted to the rotor spool, which lengthens its service life.

The invention also relates to a rotor for a gas turbine engine comprising a rotor spool and a rotor ring as explained above. The rotor thus formed is of simple design and can be assembled in a modular manner in the engine.

The invention also relates to a gas turbine engine comprising such a rotor.

BRIEF DESCRIPTION OF THE SEVERAL VIEWS OF THE DRAWINGS

The invention will be better understood with the aid of the appended drawing in which.

DETAILED DESCRIPTION OF THE INVENTION

Figure 1:
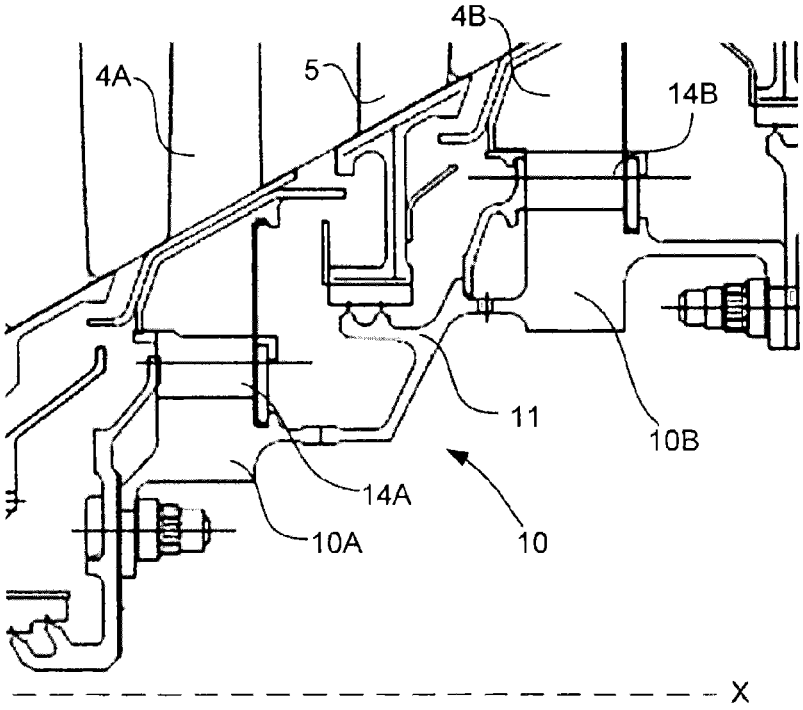
Background Art FIGURE 1
FIG. 1 is a view in section of a gas turbine engine with a rotor spool according to the prior art.
Figure 2:
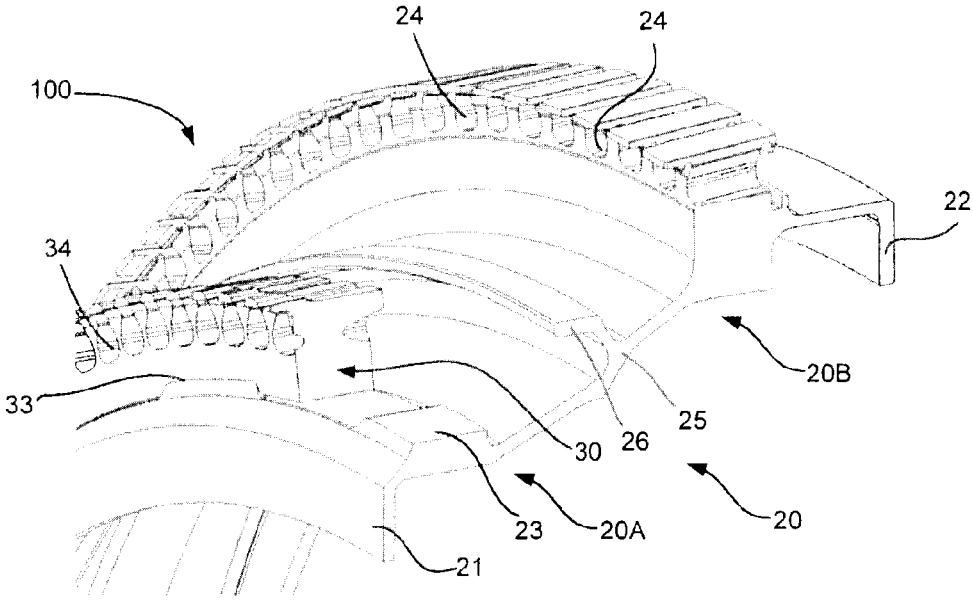
FIG. 2 is a cutaway view in perspective of a rotor with a rotor spool and a rotor ring according to the invention.

With reference to FIG. 2 representing a rotor 100 of a low-pressure turbine of a gas turbine engine according to the invention, the rotor 100 is modular and comprises a rotor spool 20, equivalent to two rotor disks, and a rotor ring 30 mounted on the rotor spool 20.

In this example, the rotor spool 20 is made by a forging method with blades made of ceramic matrix composite (CMC) material of low weight having a good temperature resistance so as to be able to withstand considerable temperatures leaving the combustion chamber. Such a rotor 100 with CMC blades advantageously has a low weight in comparison with a rotor with blades made via a conventional casting method.

The rotor spool 20 generally takes the form of a cylindrical part, substantially flared from upstream to downstream, which extends axially and comprises, from upstream to downstream, an upstream flange 21, a cylindrical upstream portion 20A, a frustoconical central portion 25 flared from upstream to downstream, a cylindrical downstream portion 20B, in which a plurality of downstream blade housings 24 are arranged and a downstream flange 22. The rotor spool 20 forms a one-piece assembly.

The downstream portion 20B of the rotor spool 20 is radially offset outward relative to its upstream portion 20A. As indicated above, the downstream blade housings 24 can be made by a conventional broaching method from downstream to upstream, the downstream portion 20B being broached right through with a bit.

The upstream portion 20A has no housings for receiving blades like its downstream portion 20B but comprises, on its outer surface, attachment teeth 23, extending radially outward, designed to attach the rotor ring 30 in order to prevent a tangential movement of the rotor ring 30 relative to the rotor spool 20.

The rotor ring 30 takes the form of a cylindrical part of which the internal diameter is substantially equal to the external diameter of the upstream portion 20A of the rotor spool 20. The rotor ring 30 comprises a plurality of upstream blade housings 34 formed in its outer surface and attachment recesses 33, extending radially inward, formed in its inner surface, arranged to receive the attachment teeth 23 of the rotor spool 20 in order to prevent a tangential movement of the rotor ring 30 relative to said rotor spool 20.

In other words, the annular rotor ring 30 is arranged in order to slip, like a bush, over the upstream portion 20A of the rotor spool 20 in order to complete it and form a rotor 100 comprising two pluralities of blade housings 34, 24 in two distinct transverse planes relative to the axis of the engine X. Therefore, the rotor 100 has two turbine stages.

The assembly of the rotor 100 is particularly simple and clever because of the interaction of the attachment teeth 23 with the attachment recesses 33 which prevent any tangential movement between the rotor ring 30 and the rotor spool 20. Moreover, the rotor 100 thus formed has similar dimensions to the rotors of the prior art. Its installation into an existing engine advantageously requires no modification.

Preferably, the dimensions of the attachment recesses 33 and of the attachment teeth 23 are adapted so as to arrange between them a radial space allowing a stream of cooling air to pass through.

The formation of the upstream blade housings 34 in the rotor ring 30 presents no problem since the rotor ring 30 is an element that is independent of the rotor spool 20. Therefore, the broaching method can be applied for the formation of the upstream blade housings 34.

The mounting of the rotor 100 and its operation will be explained in detail below.

Figure 3:
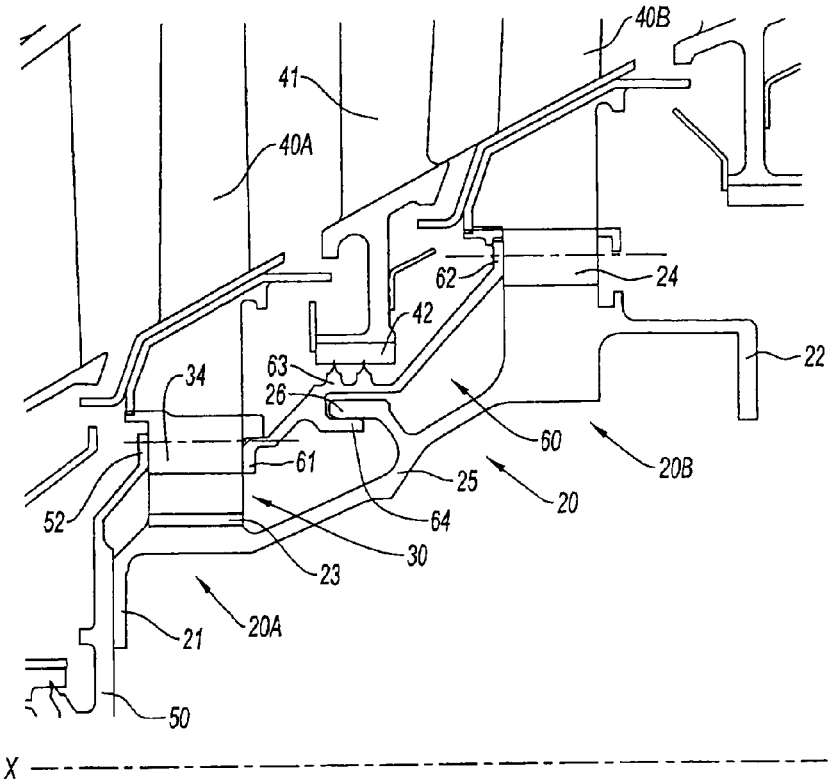
FIG. 3 is a view in section of a gas turbine engine with a rotor according to the invention.

With reference now to FIG. 3, the stator blades 41 are first installed in the engine and they are designed to be mounted downstream of the upstream blades 40A, which presents no problem since the rotor spool 20 is not yet mounted.

The downstream rotor blades 40B are mounted in the housings 24 of the rotor spool 20. Then, a sealing ring 60 is slipped axially and externally over the rotor spool 20, this sealing ring 60 also being known as the "labyrinth ring".

The sealing ring 60 comprises a circumferential groove 64 with downstream axial opening, which interacts with a tongue 26 extending axially in the upstream direction, formed on the outer surface of the frustoconical central portion 25 of the rotor spool 20 in order to prevent the axial movement of the sealing ring 60 relative to the rotor spool 20. The rotor spool 20 with its sealing ring 60 is then installed in the engine.

Moreover, the upstream blades 40A are inserted from downstream to upstream into the upstream housings 34 of the ring 30.

The ring 30 is then mounted onto the rotor spool 20 so that the attachment teeth 23 of the upstream portion 20A of the rotor spool 20 interact with the attachment recesses 33 of the rotor ring 30. The upstream blades 40A therefore axially block, from upstream, the sealing ring 60 mounted on the downstream portion of the rotor spool 20.

Then an upstream retaining endpiece 50 is mounted on the rotor spool 20 upstream of the rotor ring 30. The upstream blades 40A are thus axially blocked in their upstream housings 34 by the downstream end 52 of an upstream retaining endpiece 50. The upstream flange 21 of the rotor spool 20 is then pressing on the downstream face of the upstream retaining endpiece 50 and the upstream end 61 of the sealing ring 60 is in contact with the downstream face of the blade roots of the upstream rotor 40A held in the upstream housings 34 of the rotor ring 30.

It goes without saying that the rotor spool 20 could also be mounted with the rotor ring 30 by shrink-fitting.

The upstream flange 21 of the rotor spool 20 is connected to a downstream flange upstream of another rotor spool (not shown) by attachment means of the screw and nut type. Preferably, the flanges are scalloped so as to lighten the weight of the engine.

Therefore, the upstream rotor blades 40A are blocked axially by the retaining endpiece 50 upstream and by the sealing ring 60 downstream.

Moreover, the sealing ring 60 comprises, in line with the stator blades 41, sealing strips 63, extending radially outward, arranged in order to interact with an abradable layer 42 secured to the stator blades 41 in order to form a labyrinth seal.

In this example, the downstream rotor blades 40B are mounted on the rotor spool 20 prior to the mounting of the rotor spool 20 onto its ring 30. However, it goes without saying that the downstream rotor blades 40B could be mounted subsequently. In any case, the downstream rotor blades 40B are blocked axially upstream by the downstream end of the sealing ring 60.

In operation, the air flow originating from the combustion chamber flows from upstream to downstream in the engine and rotates the upstream blades 40A. The air flow is then straightened out by the stator blades 41 in order to rotate the downstream blades 40B.

The driving of the upstream blades 40A by the air flow generates a torque which is transmitted to the rotor spool 20 by means of the rotor ring 30 via the attachment recesses 33 and the attachment teeth 23 which transmit the tangential forces. On the other hand, the centrifugal force generated by the rotation of the upstream blades 40A is not transmitted to the rotor spool 20 because there are no radial connection means between the rotor ring 30 and the rotor spool 20. Therefore, the centrifugal forces are applied only to the rotor ring 30 which protects the rotor spool 20. The rotor blades are in this instance made of a light material (for example a ceramic matrix composite (CMC) material) and are lighter. The centrifugal forces applied to the rotor ring 30 are then weaker in comparison with an engine of the prior art. The rotor ring 30 can therefore withstand such centrifugal forces.

Attachment means have been described here with teeth and recesses but it goes without saying that splines or claws could be equally suitable.

A rotor spool has been described here that is equivalent to two rotor disks but it goes without saying that the invention applies to a one-piece rotor spool equivalent to more than two rotor disks. Accordingly, the portions of the rotor spool that are radially inside another portion of the rotor spool comprise rotor rings that are broached independently.

The invention has been described for a turbine spool but it goes without saying that the invention also applies to a compressor spool of a gas turbine engine. In this case, the radially outer portion of the spool corresponds to the upstream portion and the radially inner portion corresponds to the downstream portion.

The invention claimed is:

1. A rotor for a gas turbine engine comprising:

a one-piece rotor spool extending along an axis of the engine, the spool comprising a cylindrical radially inner portion and a cylindrical radially outer portion that are radially offset from each other; and a cylindrical rotor ring which is independent from the spool such that the ring is separable from and mountable on the spool, wherein the radially outer portion includes a plurality of housings for rotor blades formed in an outer surface of the radially outer portion, wherein the rotor ring includes a plurality of housings of rotor blades formed in an outer surface of the ring, and wherein an outer circumferential surface of the radially inner portion of the spool includes an attachment mechanism which cooperates with an attachment device of the rotor ring, which is formed in an inner circumferential surface of the ring in order to prevent a tangential movement of the rotor ring relative to the rotor spool, an outer diameter of the outer circumferential surface of the radially inner portion being substantially equal to an inner diameter of the inner circumferential surface of the ring.

2. The rotor as claimed in claim 1, wherein the attachment mechanism is arranged in order to allow an axial movement of the rotor ring relative to the radially inner portion.

3. The rotor as claimed in claim 1, wherein the attachment mechanism includes attachment teeth extending radially outward.

4. The rotor as claimed in claim 1, wherein the radially outer portion of the spool is downstream of the radially inner portion.

5. The rotor as claimed in claim 1, wherein the attachment device comprises attachment recesses extending radially inward.

6. A gas turbine engine comprising a rotor as claimed in claim 5.

7. The rotor as claimed in claim 1, wherein the spool includes a frustoconical central portion connecting the radially inner portion and the radially outer portion.

* * * * *